US005400123A

United States Patent [19]

Sato et al.

[11] Patent Number: 5,400,123

[45] Date of Patent: Mar. 21, 1995

[54] IMAGE FORMING APPARATUS CAPABLE OF ERASING AN IMAGE RECORDED IN A SHEET

[75] Inventors: Masumi Sato; Keizo Yasuda; Motokazu Yasui; Kenichi Hasegawa; Eiji Sawamura, all of Yokohama; Masahiko Sato, Tokyo; Yasuhisa Kato; Masano Ehara, both of Yokohama, all of Japan

[73] Assignee: Ricoh Company, Ltd., Tokyo, Japan

[21] Appl. No.: 98,023

[22] Filed: Jul. 28, 1993

[30] Foreign Application Priority Data

Jul. 31, 1992 [JP] Japan ..... 4-205356
Aug. 7, 1992 [JP] Japan ..... 4-211747

[51] Int. Cl.[6] ..... G03G 21/00

[52] U.S. Cl. ..... 355/218; 15/77; 15/102; 134/122 R; 134/122 P; 355/200; 355/210

[58] Field of Search ..... 355/200, 210, 218, 296, 355/298, 300, 301, 269; 15/77, 102; 134/122 R, 122 P, 64 R, 64 P; 430/106

[56] References Cited

U.S. PATENT DOCUMENTS 3,108,895 10/1963 Howell .
3,237,231 3/1966 Zink .
3,242,517 3/1966 Buros et al. .
3,440,675 4/1969 Yeaman .
3,938,213 2/1976 Difede ..... 15/77
3,974,539 8/1976 Barouh et al. ..... 15/104.001
4,845,524 7/1989 Okamoto et al. ..... 355/218 X
5,045,420 9/1991 Hosono et al. ..... 430/106 X

OTHER PUBLICATIONS

Patent Abstracts of Japan, P-721, Jun. 25, 1988, vol. 12, No. 224, JP-A-63 17479, Jan. 25, 1988.
Patent Abstracts of Japan, P-908, Aug. 2, 1989, vol. 13, No. 342, JP-A-1 101576, Apr. 19, 1989.

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

An image forming apparatus has an erasing device therein which automatically erases an image formed on a sheet by a recording agent implemented by a decolorizable coloring agent, e.g., toner. The erasing device emits light having a wavelength range of 820 nm or so while generating heat and may be constituted by a halogen lamp. As a result, the sheet is regenerated and can be repetitively used.

29 Claims, 11 Drawing Sheets

IMAGE FORMING APPARATUS CAPABLE OF ERASING AN IMAGE RECORDED IN A SHEET

BACKGROUND OF THE INVENTION

The present invention relates to a copier, facsimile apparatus, printer or similar image forming apparatus having a function of erasing an image recorded on a sheet by a recording agent which is implemented by a decolorizable coloring agent.

Papers wasted in offices are one of various wastes taking growing interest from the standpoint of, among others, the protection of natural resources. To reduce waste papers, recycling documents used in offices, i.e., so-called OA (Office Automation) sheets is desperately needed today. At the present stage of development, rerecycling OA documents requires collection of OA sheets used by, e.g., a copier or a printer while classifying them, melt them, remove ink, and then make sheets. Sheets regenerated by such a procedure are reused. However, it has been reported that only 5 percent of as great as 250,000 tons of OA sheets consumed in offices is collected now as matters stand.

On the other hand, there has been proposed another type of OA sheet recycling system wherein images are printed on OA sheets by using a toner, ink or similar recording agent implemented by a decolorizable coloring agent. In this type of scheme, when the OA sheets with images become needless, the toner or ink is removed from the sheets to allow other images to be newly printed on sheets, i.e., to implement OA recycling within the office. Consisting of a cyanin-based coloring matter and ammonium salt, the decolorizable coloring agent loses color when irradiated by light having a wavelength range of 820 nm or so. For example, in an ordinary electrophotographic image forming apparatus, when this kind of coloring agent is substituted for carbon black which is the coloring agent of the apparatus, images printed on sheets appear blue under usual illumination and are as legible as ordinary recordings. By forming images on OA sheets using such a unique coloring agent, it is possible to regenerate used sheets relatively easily. This is extremely useful to save natural resources, to preserve the environment, and to reduce wastes.

A device for erasing images formed on sheets by the decolorizable coloring agent has been proposed in some forms in the past. However, all of them are constructed as a unit and used independently of an image forming apparatus. Therefore, to reuse sheets, it is necessary to decolorize the images of the sheets by the erasing device, and then load the decolorized sheets on the image forming apparatus, slowing down the image forming operation.

SUMMARY OF THE INVENTION

It is therefore an object of the present invention to provide an image forming apparatus capable of automatically erasing an image formed on a sheet by a toner or similar recording agent implemented by a decolorizable coloring agent by a single operation, thereby regenerating the sheet and then forming a new image thereon.

It is another object of the present invention to provide an image forming apparatus in which an erasing device for erasing an image formed on a sheet by a decolorizable coloring agent is incorporated.

In accordance with the present invention, an image forming apparatus having a function of recording a visible image on a sheet by depositing a recording agent implemented as a coloring agent on the sheet, and a function of erasing the visible image recorded on the sheet by the coloring agent comprises the recording section for recording visible image on the sheet fed to the recording section, an erasing section constructed integrally with the image recording section for erasing the visible image recorded on the sheet by a coloring agent.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter.

1st Embodiment

Figure 1:
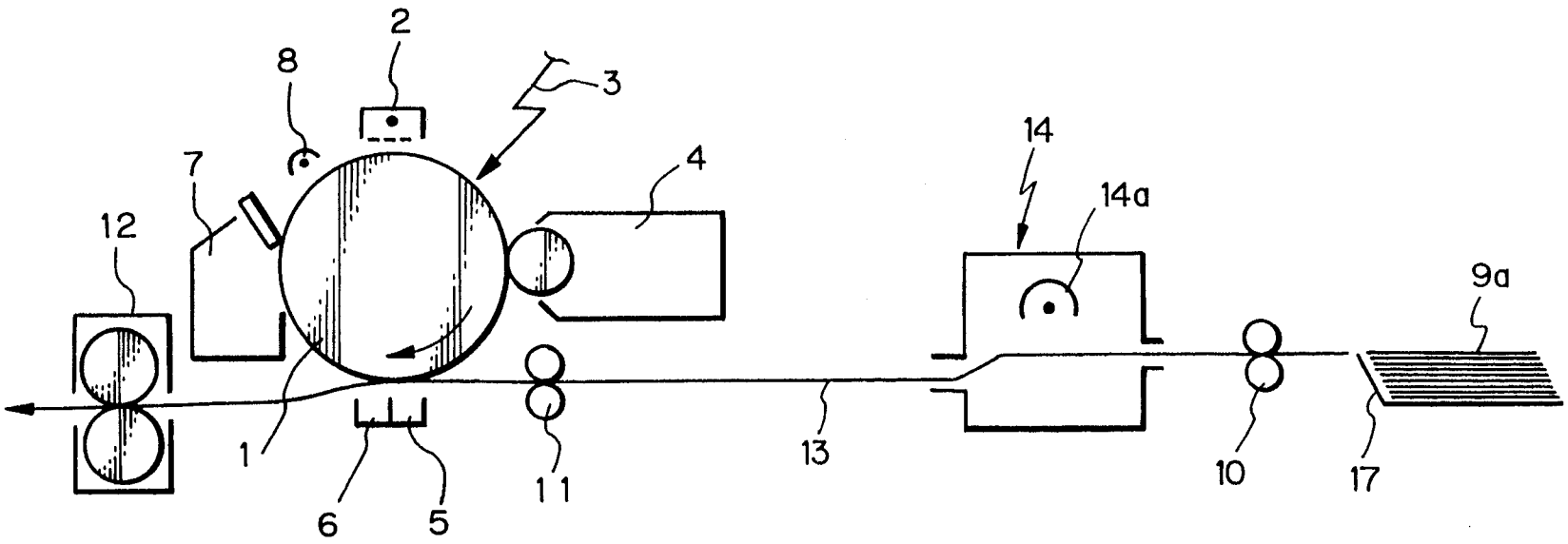
FIG. 1 is a section showing an embodiment of the image forming apparatus in accordance with the present invention.

Referring to FIG. 1 of the drawings, an image forming apparatus embodying the present invention is shown which incorporates an erasing device for erasing an image formed on a sheet by a toner implemented as a decolorizable coloring agent therein. Briefly, this embodiment has an operation control unit, e.g., a microcomputer for causing the erasing device to selectively operate in a decolorize mode or an ordinary image form mode. In the decolorize mode, when a sheet is passed through the erasing device only once, the erasing device fully erases the image formed on the sheet by, e.g., a toner implemented as a decolorizable coloring agent. In the ordinary image form mode, the erasing device is held inoperative and does not erase the image on the sheet. Alternatively, an arrangement may be made such that in the decolorize mode the degree of erasure, i.e., decolorizing level of the erasing device is variable so as not to fully decolorize the image on the sheet, thereby leaving the image as a light background for an image to be formed afterwards. This is also implemented by the operation control unit.

As shown in FIG. 1, the image forming apparatus has a photoconductive element in the form of a drum 1 which is rotatable in a direction indicated by an arrow. A main charger 2, a developing unit 4, a transfer charger 5, a separation charger 6, a cleaning unit 7 and a discharge lamp 8 are sequentially arranged around and in the direction of rotation of the drum 1. The developing unit 4 stores a toner which i s an ordinary undecolorizable toner. A laser beam 3 scans the surface of the drum 1 at an exposing station between the main charger 2 and the developing unit 4. A sheet 9*a* is fed from a tray 17 by a pick-up roller 10. An erasing device 14 has a halogen lamp or similar source of light and heat 14*a*, as will be described specifically later. A registration roller pair 11, a fixing unit 12 and a discharge tray, not shown, are also included in the apparatus. The sheet 9a fed from the tray 17 is transported along a transport path 13.

In operation, in the ordinary image form mode, the drum 1 is uniformly charged by the main charger 2 while being rotated in the above-mentioned direction. The laser beam 3 scans the charged surface of the drum 1 in a direction perpendicular to the direction of rotation of the drum 1, thereby electrostatically forming a latent image thereon. The developing unit 4 develops the latent image to produce a corresponding toner image. The sheet 9a fed from the tray 17 is brought to the registration roller pair 11 along the transport path 13 by way of the erasing device 14. The registration roller pair 11 drives the sheet 9a at a predetermined timing to an image transfer station where the transfer charger 5 is located. At the image transfer station, the transfer charger 5 transfers the toner image from the drum 1 to the sheet 9a. Subsequently, the sheet 9a with the toner image is separated from the drum 1 by the separation charger 6 and then transported to the fixing unit 12. The fixing unit 12 fixes the toner image on the sheet 9a. The toner remaining on the drum 1 after the image transfer is removed by the cleaning unit 7. Further, the charge remaining on the drum 1 after the cleaning is dissipated by the lamp 8. Thereafter, the above-stated procedure i s repeated to form the next image on the drum 1.

Figure 2:
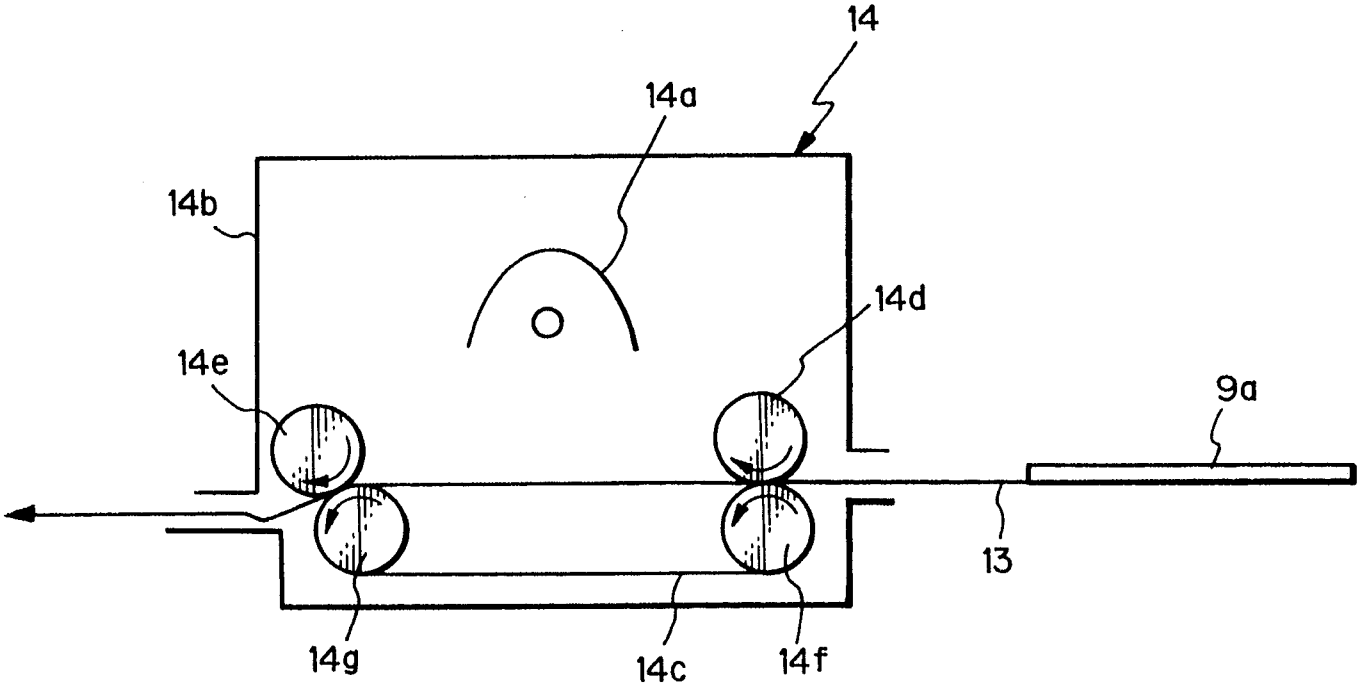
FIG. 2 is a section showing a specific construction of an erasing device included in the embodiment.

FIG. 2 shows a specific construction of the erasing device 14 in detail. The halogen lamp or similar light and heat source 14a emits light having, basically, a wavelength range of 820 nm or so and generates heat. Should the light and heat from the halogen lamp 14a leak to the outside of the erasing device 14, it would affect image formation or would practically prevent an image from being formed. To eliminate this problem, the erasing device 14 is provided with a case 14b enclosing the lamp 14a and made of a light and heat shielding material. A belt 14c is passed over back-up rollers 14f and 14g for transporting the sheet 9a. An inlet roller 14d and an outlet roller 14e are held in contact with the back-up rollers 14f and 14g, respectively. Such components of the erasing device 14 constitute light and heat shielding means. Since decolorization is a chemical reaction, it needs some period of time to complete. Hence, it is necessary to limit the image forming speed of the apparatus or to change the process speed depending on the mode, i.e., the decolorize mode or the ordinary image form mode. In light of this, a heater is disposed in the inlet roller 14d to heat the sheet 9a, thereby accelerating decolorization.

Since the sheet 9a decolorized by the heat of the erasing device 14 is apt to curl toward the imaged surface thereof, it is undesirable to transport it directly to the image transfer station. In the illustrative embodiment, the outlet roller 14e is slightly deviated from the back-up roller 14g, as shown in FIG. 2. This successfully uncurls the curled sheet 9a before it reaches the image transfer station. Alternatively, the outlet roller 14e may be made of a softer elastic material than the back-up roller 14g. The gist is that a pressure causing the sheet 9a to uncurl should be exerted on the sheet 9a.

As shown in FIG. 1, the erasing device 14 is disposed on the transport path 13 between the sheet feed section and the image transfer station. This is the simplest configuration and locates the inlet roller 14d with the heater at a position furthest from the image forming section to avoid the adverse influence of the heater.

While the sheet 9a carrying the toner image thereon is transported in the erasing device 14, the operation control unit mentioned previously causes the inlet roller 14d to heat the sheet 9a and then causes the light and heat source 14a to decolorize the image of the sheet 9a. The decolorized sheet 9a which exits from of the erasing device 14 is recycled in the image forming apparatus, so that a new toner image may be formed thereon afterwards. The operation control unit selects either the decolorize mode wherein the erasing device 14 is operative on the image form mode wherein it is inoperative. The operation control unit may be implemented by a simple switch provided on the operation panel of the image forming apparatus for turning on or turning off the erasing device 14. Further, the operation control unit may include, e.g., a dial provided on the operation panel for controlling the quantity of light to issue from the light and heat source 14a. With such a dial, it is possible to fully erase the image formed on the sheet 9a or to reduce the density of the image to a desired degree suitable for the background of the next image, as desired.

As stated above, the erasing device 14 is built in the image forming apparatus. This embodiment ON/OFF controls the device 14 in matching relation to the decolorize mode or the ordinary image form mode and, in addition, controls the erasure level of the image. Specifically, this embodiment allows the image to be fully decolorized or to be reduced in density to serve as the light background of the next image. Despite the fact that the device 14 is built in the image forming apparatus, the light and heat shielding means prevents the light and heat from the source 14a from adversely affecting the image formation.

2nd Embodiment

Figure 3:
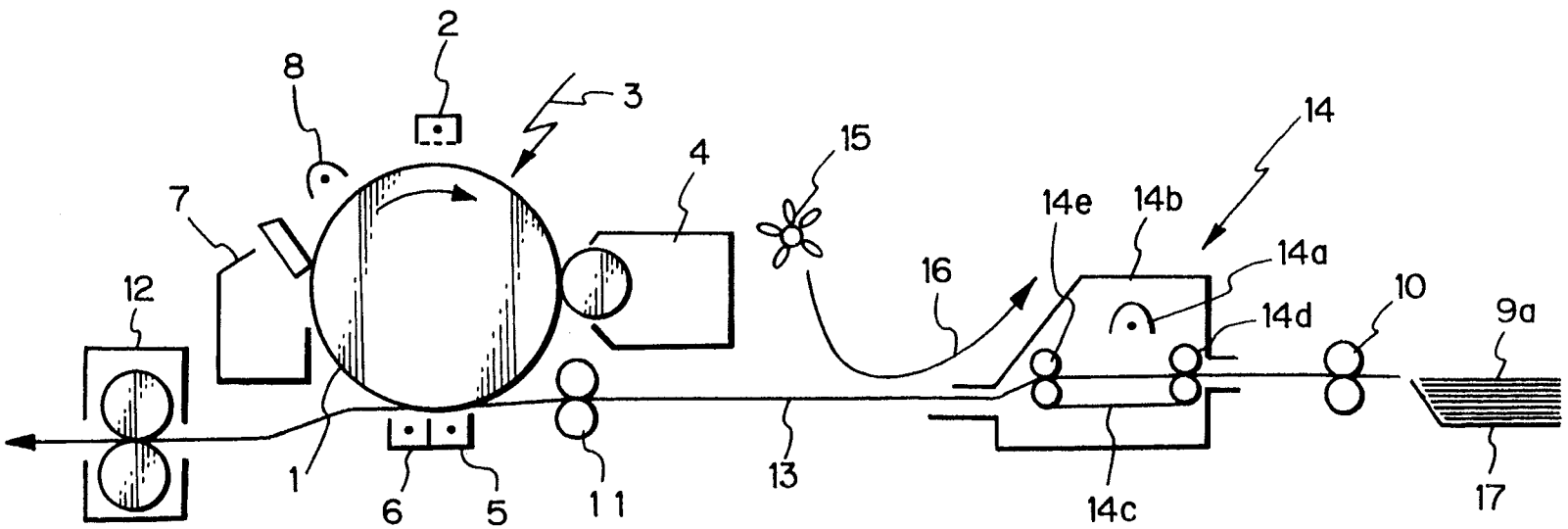
FIGS. 3–13 are sections each showing alternative embodiments of the present invention.

A second embodiment to be described is essentially similar to the first embodiment, but it is provided with a more positive measure against heat to insure stable image formation. Specifically, as shown in FIG. 3, cooling means in the form of a fan 15 is located in the space above the transport path 13 and between the transfer charger 5 and the erasing device 14. The fan 15 blows air toward the sheet 9a coming out of the erasing device 14, thereby generating an air stream 16. Although the erasing device 14 is basically the same in configuration as the device 14 of FIG. 2, it has the shape of the case 14b slightly modified in consideration of the air stream 16, as illustrated. The decolorized sheet 9 a coming out of the case 14b is cooled by the air stream 16 and then transported toward the image transfer station. It is noteworthy that the air stream 16 not only cools off the sheet 9a but also prevents the heat generated in the erasing device 14 from leaking to the image forming section. It should be noted that the position of the fan 15 shown in FIG. 3 is only illustrative and may be replaced with any other position so long as it can generate the desired air stream 16.

As stated above, the second embodiment cools off the decolorized sheet 9a by the fan 15. This promotes stable image formation and reduces the overall size of the image forming apparatus in which the erasing device 14 is included.

3rd Embodiment

Figure 4:
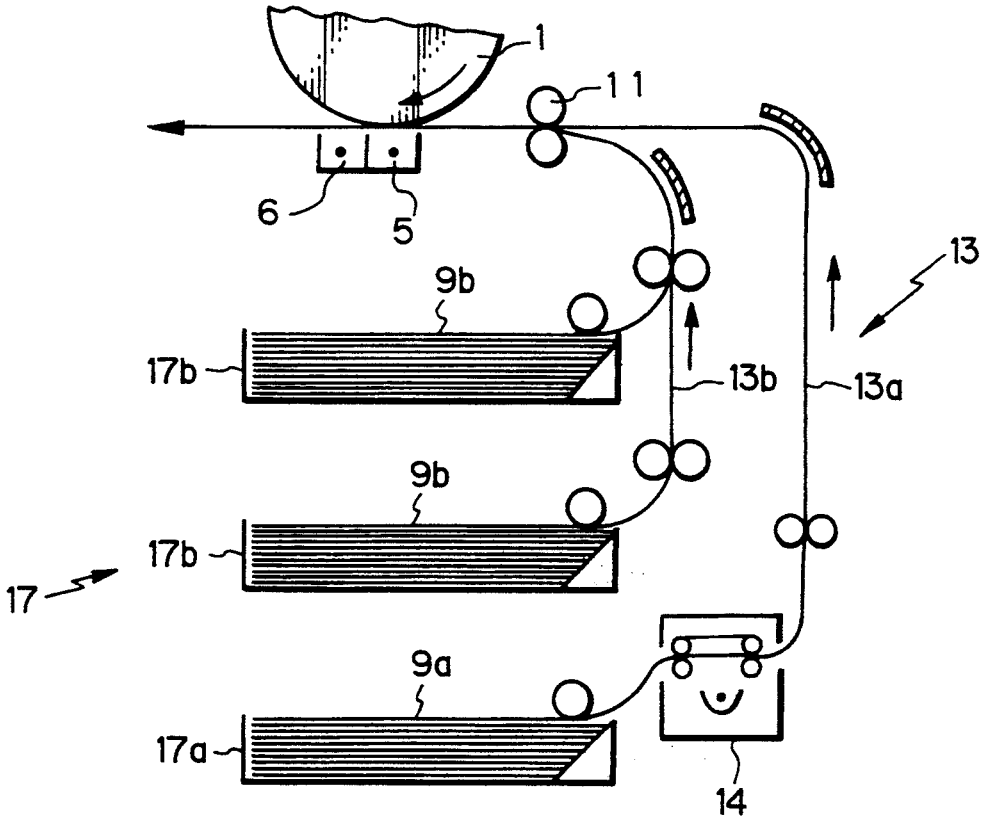

As shown in FIG. 4, a third embodiment has a unique sheet feed section 17 and a unique transport path 13. The sheet 9a carrying a decolorizable toner image thereon is fed from a cassette 17a to the image transfer station, where the transfer charger 5 and separation charger 6 are located, along a transport path 13*a* by way of the erasing device 14. On the other hand, an ordinary sheet 9*b*, e.g., a fresh sheet without an image is transported from a cassette 17*b* to the image transfer station along another transport path 13*b* where the erasing device 14 is not located. When the sheet 9*a* with the image is fed from the cassette 17*a*, the erasing device 14 is automatically turned on. As a result, the sheet 9*a* i s decolorized and then transported to the image transfer station to form a new image thereon. When the fresh sheet 9*b* is fed from the cassette 17*b*, the erasing device 14 is turned off. In this condition, the sheet 9*b* is directly transported to the image transfer station along the path 13*b*. The ON/OFF state of the erasing device 14 is set up by the operation control unit stated previously.

In this embodiment, it is preferable that the cassette 17*a* loaded with the imaged sheets 9*a* be positioned furtherest from the image forming section, and that the erasing device 14 be located in the vicinity of the cassette 17*a*.

As is clear from the above description, the illustrative embodiment allows the erasing device 14 to be located at a position which is remote from the image forming section. Hence, the influence of the device 14 on image formation is further reduced to enhance image quality. Images can be formed on fresh sheets without being affected by the device 14. In addition, the device 14 can be automatically ON/OFF controlled only if a sheet feed position or a sheet cassette and sheets are specified.

4th Embodiment

Figure 5:
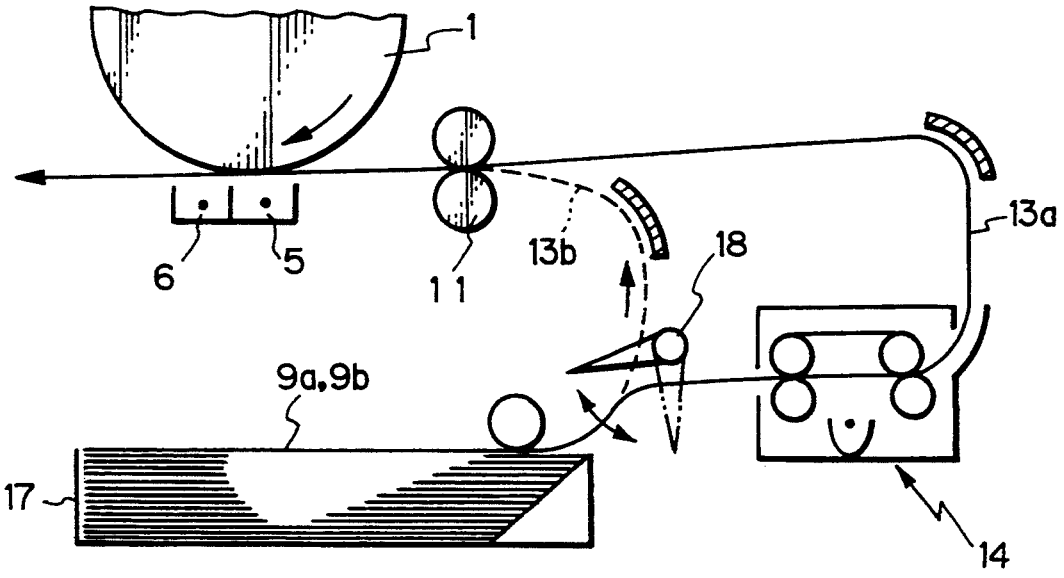

Referring to FIG. 5, a fourth embodiment of the present invention is shown. As shown, the sheet 9*a* or 9*b* from the sheet feed section 17 is selectively steered to the transport path 13*a*, where the erasing device 14 is located, or to the transport path 13*b* by path selecting means implemented as a pawl 18. Specifically, when the imaged sheet 9*a* is fed from the sheet feed section 17, the pawl 18 is so positioned as to select the transport path 13*a* by a switch provided on the operation panel of the image forming apparatus. At the same time, the erasing device 14 on the path 13*a* is automatically turned on to decolorize the image of the sheet 9*a*. When the sheet 9*b* carrying a toner image formed by an ordinary uncolorizable toner is fed from the station 17, the pawl 18 is positioned to select the other transport path 13*b* where the erasing device 14 is absent. At this instant, the erasing device 14 is held inoperative. Again, the ON/OFF state of the erasing device 14 is controlled by the operation control unit stated previously.

Preferably, the erasing device 14 should be located on the transport path 13*a* at a position as remote from the image forming section as possible.

As stated above, the fourth embodiment allows the erasing device 14 to be located remote from the image forming section. Moreover, when ordinary sheets are used, images can be formed thereon without being effected by the erasing device 14 at all, so that the influence of the device 14 on image formation is further reduced. In addition, since the erasing device 14 is automatically turned on or turned off when the operator selects a particular sheet feed position or a particular sheet cassette and sheets, the image forming apparatus is easy to operate.

5th Embodiment

Figure 6:
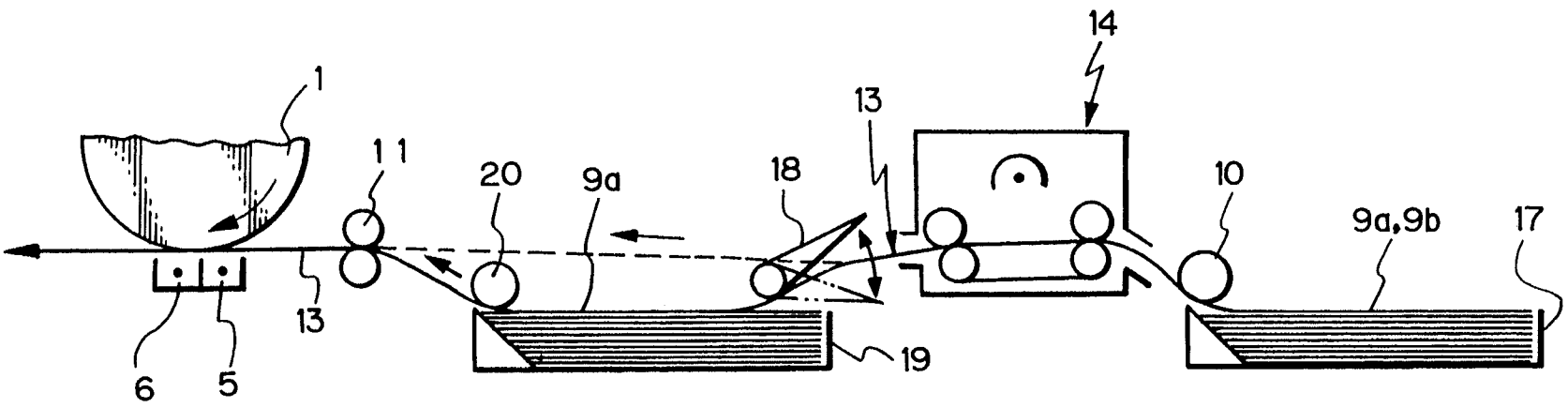

FIG. 6 shows a fifth embodiment of the present invention. As shown, an intermediate tray 19 is located on the transport path 13 between the erasing device 14 and the image transfer station where the transfer charger 5 is located. Assume that the decolorize mode operation is to be performed with the sheets 9*a* stacked on the sheet feed section 17 and each carrying an image formed by a decolorizable toner. Then, the pick-up roller 10 feeds a predetermined number of sheets 9*a* out of the station 17. The erasing device 14 is turned on to decolorize the images carried on the sheets 9*a*. A pawl 18 is so positioned as to steer the decolorized sheets 9*a* coming out of the erasing device 14 toward the intermediate tray 19. As a result, the regenerated sheets 9*a* are sequentially stacked on the intermediate tray 19. Subsequently, in the ordinary image form mode, the regenerated sheets 9*a* are sequentially fed from the intermediate tray 19 toward the image transfer station by a pick-up roller 20. On the other hand, when the ordinary sheets 9*b* are stacked in the sheet feed section 17, the ordinary image form mode is set up. In this mode, the erasing device 14 is turned off. As the pick-up roller sequentially feeds the sheets 9*b*, the sheets 9*b* are routed through the erasing device 14, which is inoperative then, to the pawl 18. At this time, the pawl 18 steers the sheets 9*b* directly to the image transfer position without first being transported to intermediary of the intermediate tray 19.

In the illustrative embodiment, the ordinary sheets 9*b* are also passed through the inoperative erasing device 14 to the image transfer station. Alternatively, the pawl 18 may, of course, be interposed between the sheet feed section 17 and the erasing device 14 to steer the sheets 9*b* to a path, not shown, by-passing the erasing device 14.

As stated above, this embodiment temporarily stacks the regenerated sheets 9*a* on the intermediate tray 19 to prevent new images from being formed on hot sheets. This promotes stable image formation. In addition, images can be formed rapidly with no regard to the decolorizing speed of the image.

6th Embodiment

Figure 7:
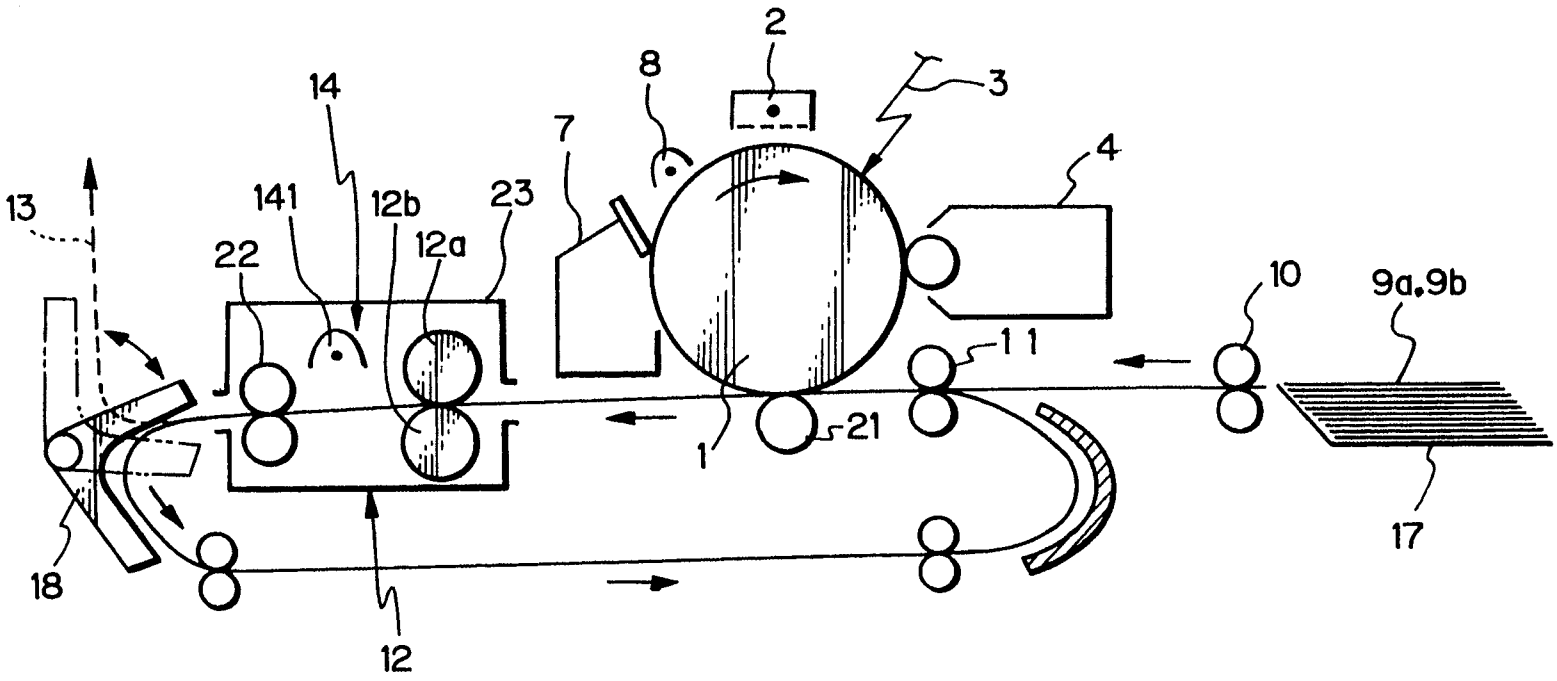

Referring to FIG. 7, a sixth embodiment of the present invention will be described. As shown, the erasing device 14 has a halogen lamp or similar light and heat source 141 located downstream of and in close proximity to the fixing unit 12. Assume that the sheets 9*a* carrying images formed by a decolorizable toner are fed from the sheet feed section 17. Then, the drum 1 is rotated as indicated by an arrow in the figure. At this instant, the image forming process including charging, exposure and development are not executed. The sheets 9*a* are sequentially fed by the pick-up roller 10 and brought to the image transfer station, where a transfer roller 21 is located, by way of the register roller pair 11. At this time, a bias voltage is not applied to the transfer roller 21, and an image is not formed on the drum 1. Hence, each sheet 9*a* is simply transported to the fixing unit 12 without being imaged. After the sheet 9*a* has moved away from the image transfer station, the drum 1 is uniformly charged by the main charger 2 and then scanned by the laser beam 3 to form a latent image. The latent image is developed by the developing unit 4.

As shown in FIG. 7, the fixing unit 12 is made up of a heat roller 12*a* and a press roller 12*b* and constitutes heat fixing means. In the decolorize mode, the fixing unit 12 heats the image of the sheet 9*a* so as to accelerate decolorization. As the light and heat source 141 is turned on, it erases the image of the sheet 9*a*. The decolorized or regenerated sheet 9a is driven out of the fixing unit 12 by a discharge roller 22. A case 23 encloses the fixing unit 12, light and heat source 141 and discharge roller 22 and is made of a light and heat shielding material.

The sheet 9a coming out of the fixing unit 12 is again directed toward the registration roller pair 11 by a pawl 18. Then, the registration roller pair 11 drives the sheet 9a toward the image transfer station at a predetermined timing. At this instant, a toner image has already been formed on the drum 1. The toner image is transferred from the drum 1 to the sheet 9a by the transfer roller 21 to which a bias voltage is applied then. Thereafter, the sheet 9a is transported to the fixing unit 12 to have the image fixed thereon. Finally, the sheet 9a is discharged from the fixing unit 12 by the discharge roller 22 via the light and heat source 141. The pawl 18 steers the sheet 9a toward the transport path 13. As a result, the sheet 9a is driven out of the image forming apparatus. At this instant, the light and heat source 141 is, of course, held inoperative by the previously stated operation control unit.

When the ordinary sheet 9b without an image is fed from the sheet feed section 17, the light and heat source 141 is not operated while the pawl 18 is so positioned as to steer the sheet 9b toward the outside of the image forming apparatus.

In the decolorize mode, the above embodiment once moves the sheet 9a between the drum 1 and the transfer roller 21. This, however, is merely to provide the apparatus with a simple construction. Alternatively, an exclusive path for the sheet 9a may be provided which by-passes the image transfer station. Further, the heat to be applied by the heat roller 12a to the sheet may be changed depending on whether the roller 12a serves as heating means for promoting decolorization or as original fixing means.

As stated above, this embodiment is capable of reducing the overall size and power consumption of the image forming apparatus by disposing the erasing device 14 in the fixing unit.

7th Embodiment

Figure 8:
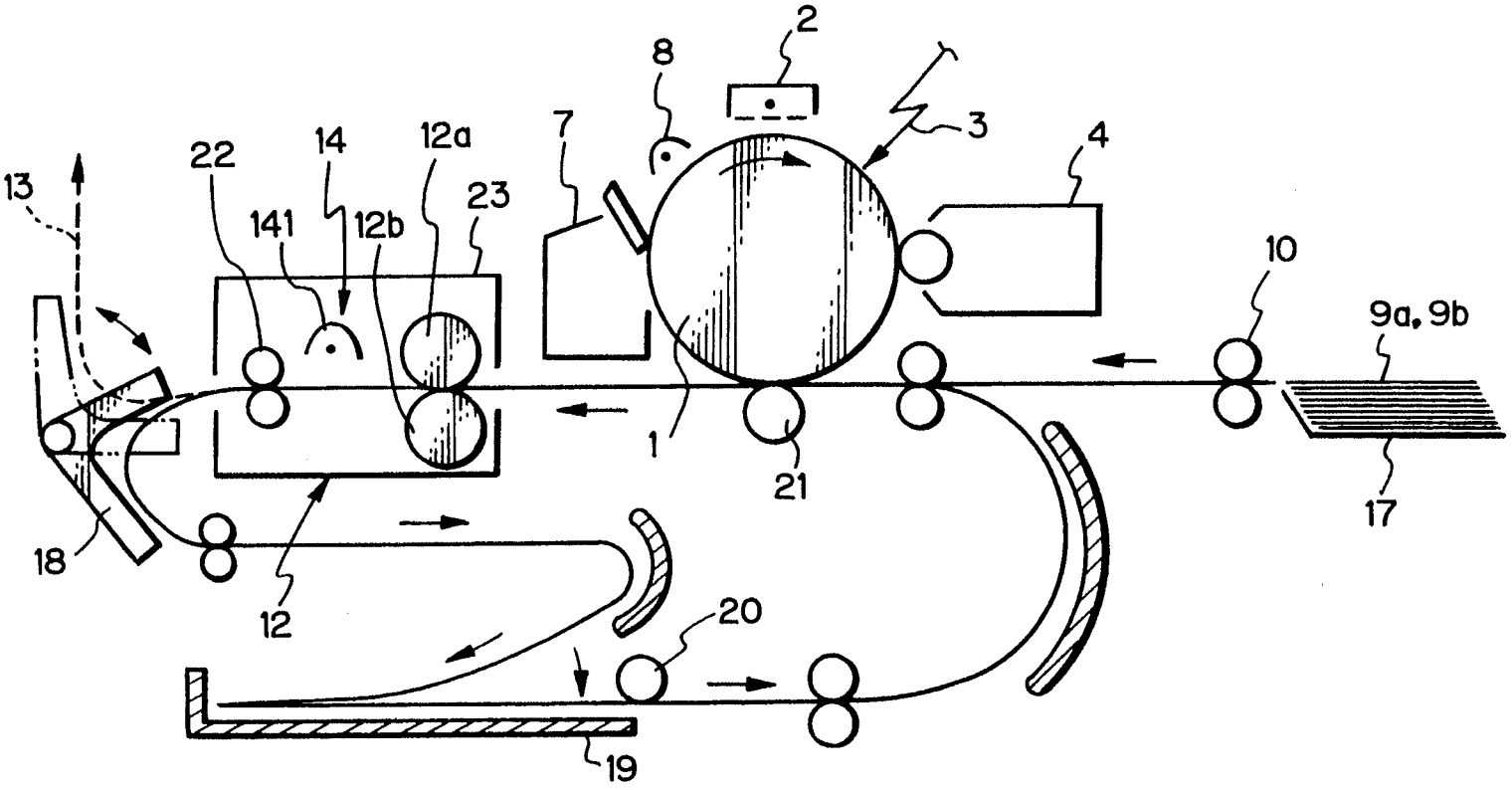

FIG. 8 shows a seventh embodiment essentially similar to the sixth embodiment except that it additionally includes the intermediate tray or two-side tray 19 having a sheet reversing function. Assume that an image is to be formed on both sides of the sheet 9b fed from the sheet feed station 17. Then, the sheet 9b is imaged on one side thereof, fixed, stacked on the intermediate tray 19, reversed in transport direction, again transported to the image transfer station by the pick-up roller 20, imaged on the other side, fixed, and then driven out of the image forming apparatus. On the other hand, assume that the sheet 9a carrying an image formed by a decolorizable toner is fed from the sheet feed section 17. Then, the sheet 9a is transported through the image transfer station to the fixing unit 12 without being imaged. At this instant, the fixing unit 12 is used as a heater for promoting decolorization. The halogen lamp or similar light and heat source 141 erases the toner image carried on the sheet 9a. The regenerated sheet 9a from the fixing unit 12 is reversed in transport direction by the intermediate tray 19 and again transported to the image transfer station by the pick-up roller 20. As a result, an image is formed on the other side or fresh side of the sheet 9a at the image transfer station. Finally, the sheet 9a is driven out of the apparatus via the fixing unit 12 and the light and heat source 141 which is inoperative then.

As stated above, this embodiment, like the sixth embodiment, disposes the erasing device 141 in the fixing unit 12 to implement a miniature and power saving image forming apparatus. Moreover, by using the intermediate tray 19 incorporated in the apparatus, the embodiment not only repetitively records and erases an image only on one side of a sheet, but also uses both sides of the sheet. Hence, sheets can be regenerated a number of times while preserving high image quality.

8th Embodiment

Figure 9:
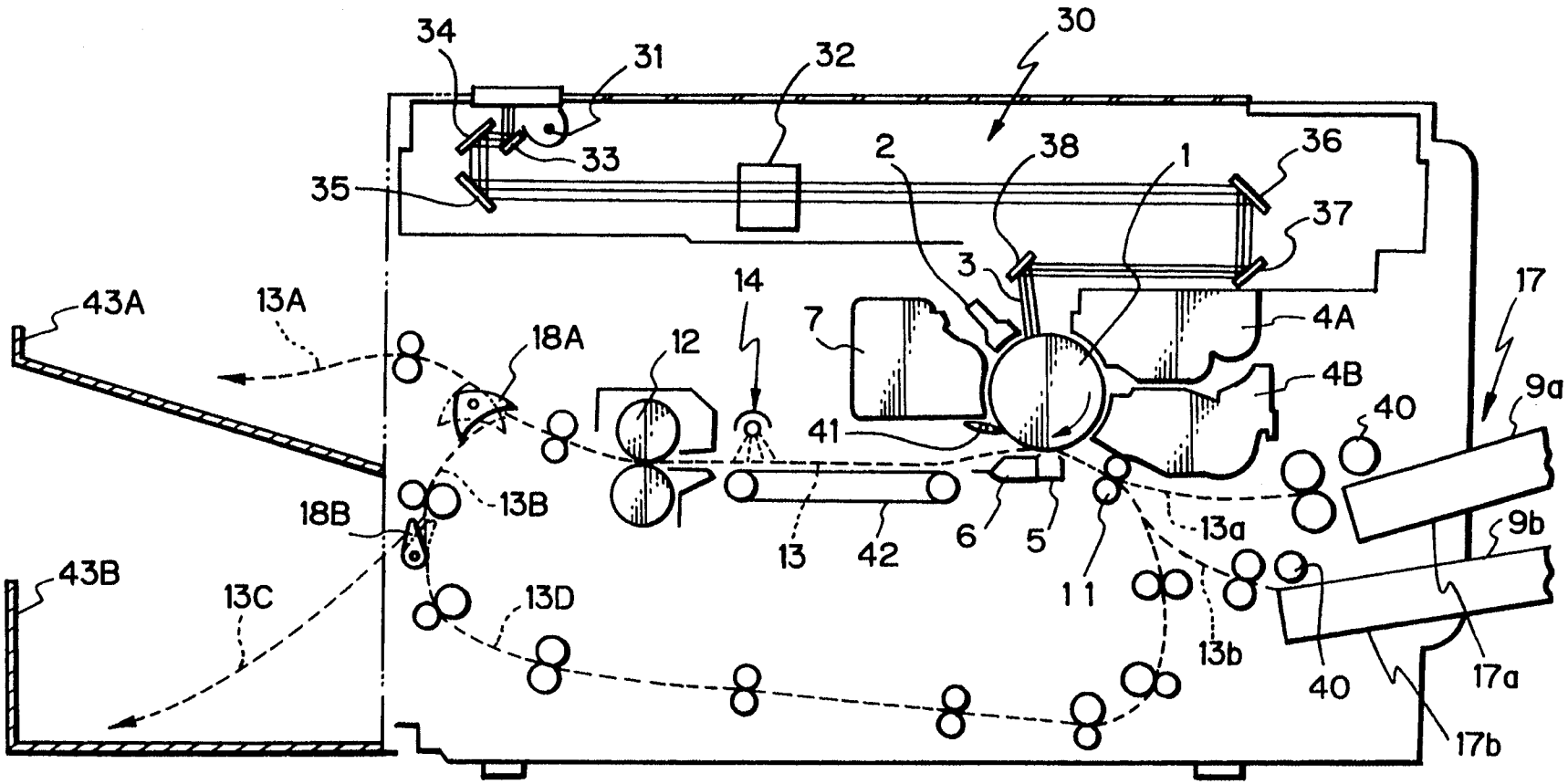

Referring to FIG. 9, an eighth embodiment of the present invention is shown. As shown, the image forming apparatus has an optical writing unit 30 made up of a light source 31, a lens 32, and mirrors 33–38. The writing unit 30 electrostatically forms a latent image on the drum 1 by scanning it with the laser beam 3. The main charger 2, a black developing unit 4A storing an ordinary undecolorizable black toner, a developing unit 4B storing a decolorizable toner, the transfer charger 5, the separation charger 6, a separator 41, and the cleaning unit 7 are sequentially arranged around and in the direction of rotation of the drum 1. The laser beam 3 is incident on the drum 1 between the main charger 2 and the developing unit 4A. Transport paths are indicated by dashed lines in the figure. Specifically, transport paths 13a and 13b respectively extend from the cassettes 17a and 17b of the sheet feed section to the registration roller pair 11. The transport path 13 extends from the transfer charger 5 to a path selector or pawl 18A by way of the separation charger 6, a transport belt 42, and the fixing unit 12. A transport path 13A extends from the pawl 18A to a discharge section 43A. A transport path 13B extends from the pawl 18A to another pawl 18B. A transport path 13C extends from the pawl 18B to another discharge section 43B. Further, a transport path 13D extends from the fixing unit 12 back to the registration roller pair 11 by way of the pawls 18A and 18B.

In this embodiment, the erasing device 14 is also implemented as the halogen lamp or similar light and heat source 14a which emits light having a wavelength range of 820 nm or so. The erasing device 14 is located above the belt 42 between the image transfer station and the fixing unit 12.

The apparatus of FIG. 9 is operable in three different modes, i.e., an ordinary image form mode wherein the black developing unit 4A forms an image by the ordinary toner, a decolorizable image forming mode wherein the developing unit 4B forms an image by the decolorizable toner, and a decolorize mode wherein a decolorizable toner image formed on a sheet is decolorized. A switch, for example, may be provided on the operation panel for selecting desired one of such three different modes.

In the decolorize mode, the sheet 9a carrying an image formed by the decolorizable toner is fed from, e.g., the cassette 17a by a pick-up roller 40. The sheet 9a is driven by the registration roller pair 11 to the belt 42. At this instant, the image forming process is not performed. Hence, the writing unit 30 is held inoperative, and so are the image forming section and fixing unit 12. The erasing device 14, i.e., the light and heat source 14a is turned on, and the belt 42 is in rotation. As a result, while the sheet 9a is transported by the belt 42 face up, the erasing device 14 erases the image of the sheet 9a. The erased or decolorized sheet 9a is steered by the pawls 18A and 18B to the discharge section 43B along the transport paths 13B and 13C. The discharge section 43B is implemented by an exclusive tray for decolorization. As a result, only the decolorized or regenerated sheets 9a are sequentially stacked on the tray 43B, freeing the operator from troublesome distinction work.

In the ordinary image form mode, the fresh sheet 9b is fed from, e.g., the sheet feed section 17b by the pick-up roller 40 and then moved to the belt 42 via the registration roller pair 11. At this instant, the image forming process is executed. At the same time, the writing unit 30 is operated, and so are the image forming section and fixing unit 12. In this case, the black developing unit 4A is selected. Although the erasing device 14 is inoperative, the belt 42 is in rotation. As a result, the sheet 9b imaged by the ordinary black toner is routed through the fixing unit 12 and transport path 13A selected by the pawl 18A to the discharge section 43A. This discharge section 43A is implemented by an exclusive tray for the sheets 9B carrying ordinary toner images thereon.

On the other hand, in the decolorizable image forming mode, the fresh sheet 9b is fed from, e.g., the cassette 17b by the pick-up roller 40 and then driven to the belt 42 by the registration roller pair 11. At this instant, the image forming process is executed. The writing unit 30, image forming section and fixing unit 12 are rendered operative. The developing unit 4B is selected to form an image by the decolorizable toner. Although the erasing device 14 is inoperative, the belt 42 is in rotation. Consequently, the sheet 9b imaged by the decolorizable toner is routed through the fixing unit 12 and transport path 13A selected by the pawl 18A to the discharge section 43A.

The decolorize mode and the ordinary image forming mode or decolorizable image forming mode may be combined, if desired. Then, by using the transport path 13D, it is possible to decolorize a sheet and then form an the image on the decolorized sheet in a continuous process.

9th Embodiment

Figure 10:
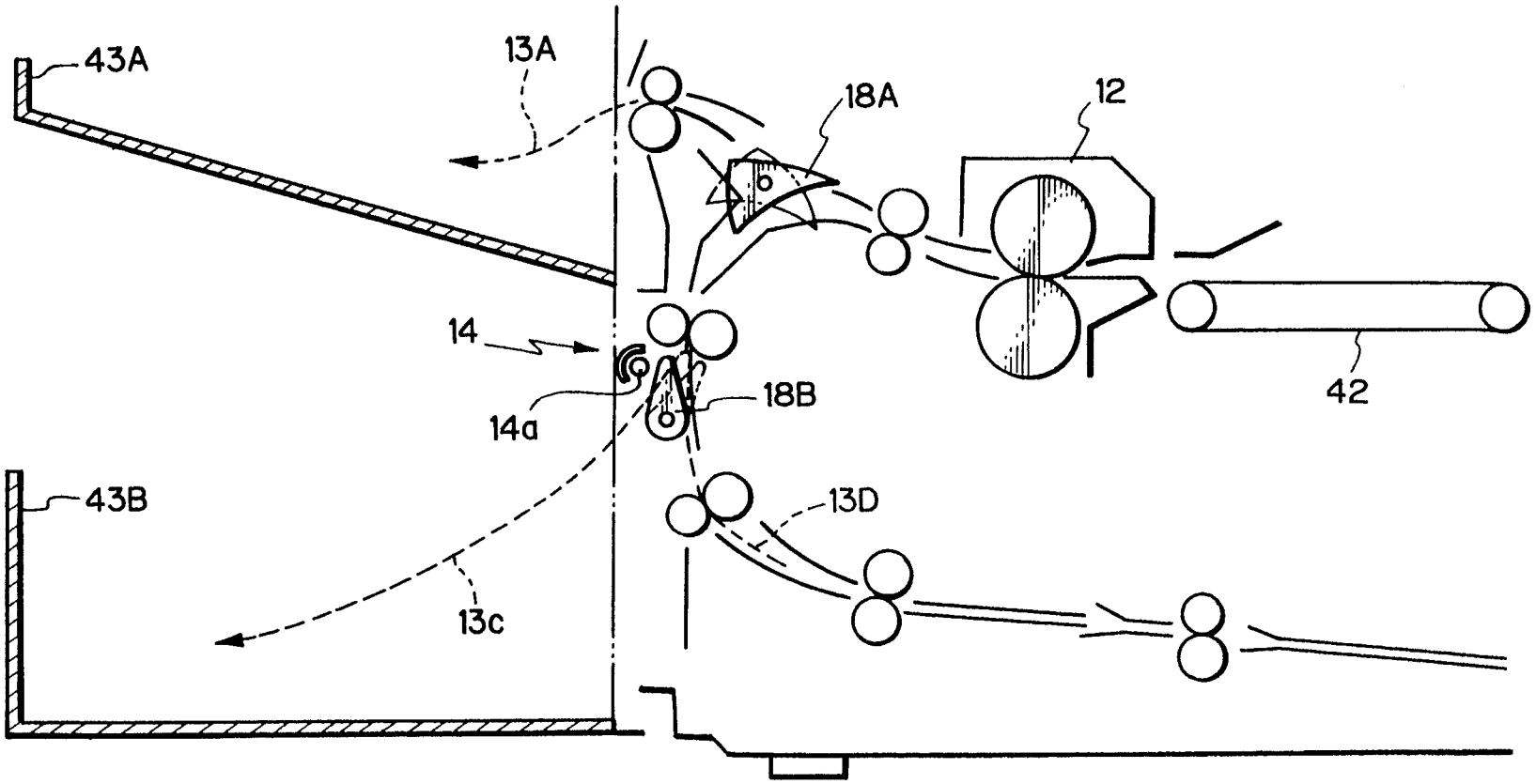

FIG. 10 shows the essential part of a ninth embodiment of the present invention. This embodiment is essentially similar to the eighth embodiment except that the erasing device 14, i.e., the light and heat source 14a is located on the transport path 13C. This configuration is successful in promoting more reliable operations. Specifically, assume that the erasing device 14 is accidentally rendered operative when the decolorizable image form mode is under way. Then, the sheet 9b reaches the discharge section 43A before it reaches the erasing device 14. Hence, the decolorizable image carried on the sheet 9b is prevented from being erased.

10th Embodiment

Figure 11:
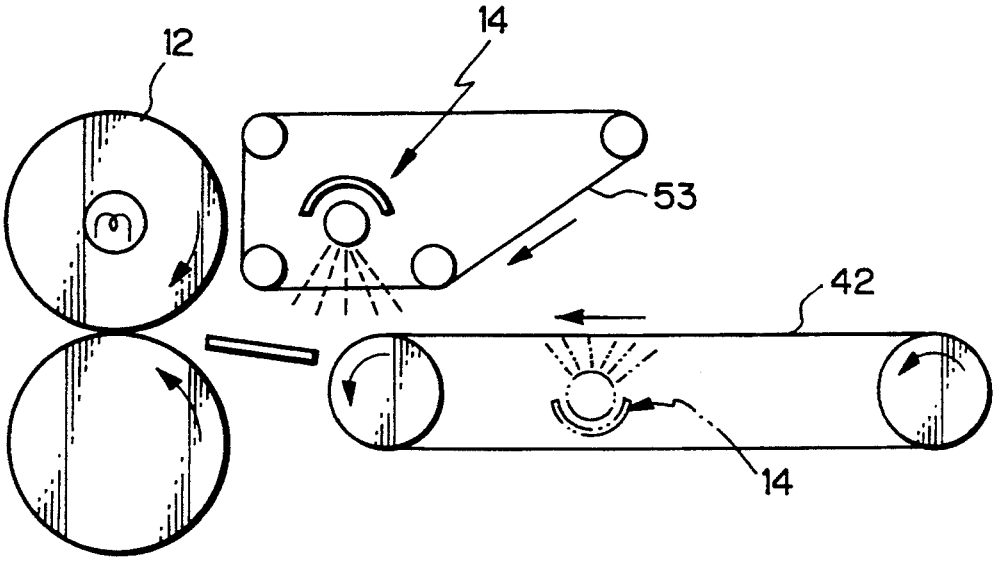

FIG. 11 shows a tenth embodiment of the present invention similar to the ninth embodiment except that the erasing device 14 disposed above the belt 42 is surrounded by a light transmitting belt 53. The light transmitting belt 53 is located above the trailing end of the belt 42 and in the vicinity of the belt 42. When the leading edge portion of the sheet is curled, the belt 53 serves to receive it and help the belt 42 transport the sheet. The distance between the belts 42 and 53 is selected such that in the ordinary image forming and decolorizable image form mode, the belt 53 does not contact an unfixed image being transported by the belt 42.

If desired, the erasing device 14 may be interposed between the opposite runs of the belt 42, as indicated by phantom lines in FIG. 11. Then, the light transmitting belt 53 can be omitted, and the belt 42 will be made of a light transmitting material.

As stated above, this embodiment allows the erasing device 14 to be located in the vicinity of the transport path. This not only enhances efficient decolorization but also saves energy.

11th embodiment

Figure 12:
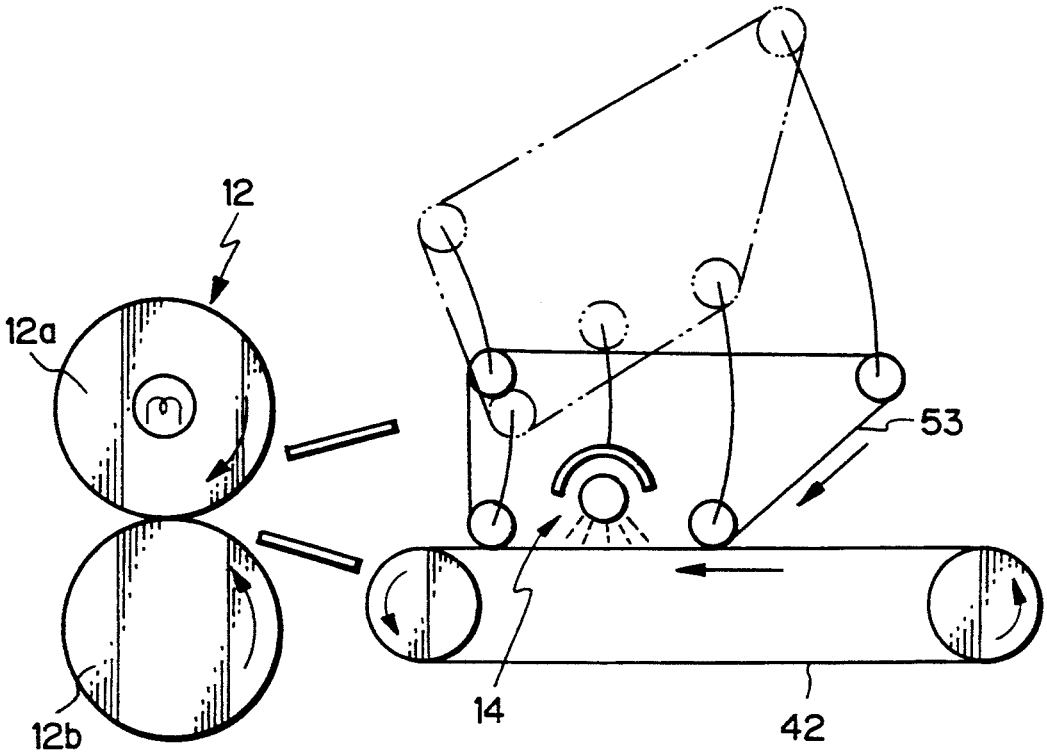

Referring to FIG. 12, an eleventh embodiment of the present invention is shown. As shown, the light transmitting belt 53 and erasing device 14 are constructed into a single unit which is movable toward and away from the belt 42. Specifically, the belt and erasing device unit are pivotable about the upper or heat roller 12a of the fixing unit 12. When this unit is moved toward the belt 42, the belt 53 contacts the belt 42; when the former is moved away from the latter, the belt 53 is spaced apart from the belt 42. The distance between the belts 42 and 53 when they are spaced part is selected such that the belt 53 does not contact an unfixed toner image in the ordinary image form mode. To move the belt 53 away from the belt 42, use may be made of a gear mounted on a shaft and driven by a motor, or a solenoid device, although not shown in the figure.

12th Embodiment

Figure 13:
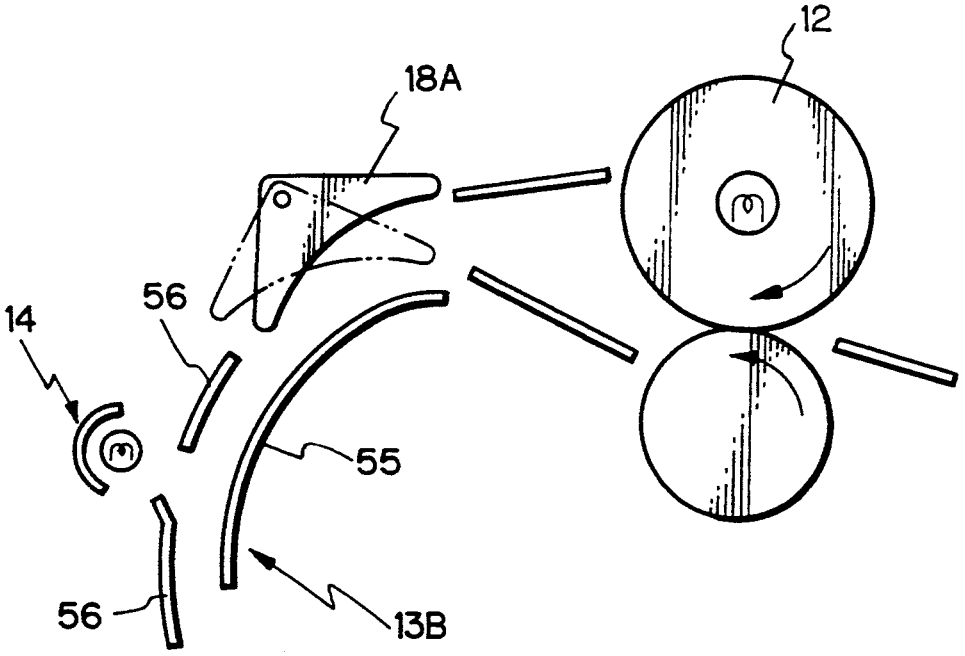

FIG. 13 shows a twelfth embodiment of the present invention in which the erasing device 14 is located on the transport path 13B downstream of the pawl 18A. Specifically, the transport path 13B is formed by curved guides 55 and 56. The erasing device 14 is positioned at the outside of the curve of the guides 55 and 56. In this configuration, the sheet is transported along the path 13B while having the curved portion thereby guided by the outer guide 56. As a result, the decolorizing surface of the sheet is brought closer to the erasing device 14 and, therefore, decolorized at higher efficiency. Part of the outer guide 56 facing the erasing device 14 is removed to allow the light from the device 14 to sufficiently reach the sheet.

As stated above, in the illustrative embodiment, the sheet steered by the pawl 18A moves along the pawl 18A and the guide 56. Consequently, the sheet is moved more stably in this portion than in the other portions and, therefore, moved closer to the erasing device 14.

In summary, in accordance with the present invention, an image forming apparatus incorporates an erasing device capable of decolorizing a sheet imaged by a decolorizable toner to reuse the decolorized sheet therein. Hence, the apparatus is capable of automatically decolorizing a decolorizable image of a sheet by a single operation, thereby regenerating the sheet.

Various modifications will become possible for those skilled in the art after receiving the teachings of the present disclosure without departing from the scope thereof. For example, the erasing device has been shown and describing as decolorizing an image by light and heat. Alternatively, a white toner may be applied to the entire surface of a sheet to erase an image carried thereon, or the image on the sheet may be rubbed mechanically by a roller having a rough surface. Regarding the roller scheme, a toner may advantageously be fixed on an overhead projector (OHP) sheet or similar special sheet at a low fixing degree. Such alternative implementations are practicable with no regard to the kind of the toner forming an image.

What is claimed is:

1. An image forming apparatus having a function of recording a visible image on a sheet by depositing a recording agent implemented as a coloring agent on said sheet, and a function of erasing a visible image recorded on said sheet by said coloring agent, said apparatus comprising:

recording means for recording said visible image on said sheet fed to said recording means; and erasing means constructed integrally with said image recording means for erasing said visible image recorded on said sheet by said coloring agent.

2. An apparatus as claimed in claim 1, wherein said recording means comprises:

feeding means for feeding said sheet;

a transport path along which said sheet is transported;

image forming means for forming said visible image;

transferring means for transferring said visible image to said sheet; and fixing means for fixing the image transferred to said sheet.

3. An apparatus as claimed in claim 2, wherein said erasing means is located above said transport path between said feeding means and said transferring means.

4. An apparatus as claimed in claim 3, wherein said erasing means comprises a light and heat source for emitting light having a predetermined wavelength range and generating heat.

5. An apparatus as claimed in claim 4, further comprising light and heat shielding means interposed between said light and heat source and said image forming means for shielding the light and heat generated by said light and heat source.

6. An apparatus as claimed in claim 5, wherein said light and heat shielding means comprises a case enclosing said light and heat source.

7. An apparatus as claimed in claim 5, wherein said erasing means is rendered operative during a decolorize mode operation or inoperative during an ordinary image form mode operation.

8. An apparatus as claimed in claim 5, further comprising cooling means for cooling said sheet after the image of said sheet has been erased by said erasing means.

9. An apparatus as claimed in claim 8, wherein said cooling means comprises a fan interposed between said erasing means and said transferring means.

10. An apparatus as claimed in claim 3, wherein said feeding means comprises:

a first cassette loaded with sheets carrying images to be erased; and a second cassette loaded with ordinary sheets on which images are to be newly recorded;

said erasing means being located on said transport path between said first cassette and said second cassette.

11. An apparatus as claimed in claim 3, wherein said transport path comprises two branch paths diverging at a first point located between said feeding means and s a i d transferring means and close to said feeding means, and then converging at a second point close to said transferring means, said erasing means being provided on either of said two branch paths.

12. An apparatus as claimed in claim 11, further comprising selecting means located at said first point for selecting one of said two branch paths along which said sheet fed from said feeding means should be transported.

13. An apparatus as claimed in claim 3, further comprising stacking means for temporarily stacking in said apparatus the sheets whose images have been erased by said erasing means.

14. An apparatus as claimed in claim 13, wherein said stacking means comprises an intermediate tray located on said transport path between said erasing means and said transferring means.

15. An apparatus as, claimed in claim 2, wherein said erasing means is located on said transport path downstream of said transferring means.

16. An apparatus as claimed in claim 15, wherein said erasing means is located in close proximity to said fixing means, which is located downstream of said transferring means, and downstream of a heat roller included in said fixing means, said heat roller promoting a decolorizing reaction.

17. An apparatus as claimed in claim 16, wherein said erasing means comprises a light and heat source for emitting light having a predetermined wavelength range and generating heat.

18. An apparatus as claimed in claim 17, further comprising light and heat shielding means interposed between said light and heat source and said image forming means for shielding the light and heat generated by said light and heat source.

19. An apparatus as claimed in claim 18, wherein said light and heat shielding means comprises a case surrounding said fixing means and said light and heat source.

20. An apparatus as claimed in claim 19, further comprising reversing means for turning over, in said apparatus, the sheet whose image has been erased by said erasing means.

21. An apparatus as claimed in claim 20, wherein said reversing means comprises an intermediate or two-side tray to be used in a two-side image form mode.

22. An apparatus as claimed in claim 15, wherein said recording means further comprises a transport belt extending along said transport path between said transferring means and said fixing means, said erasing means being disposed above said transport belt.

23. An apparatus as claimed in claim 22, further comprising a light transmitting belt surrounding said erasing means.

24. An apparatus as claimed in claim 23, wherein said erasing means and said light transmitting belt are constructed into a unit body which is movable toward and away from said transport belt.

25. An apparatus as claimed in claim 2, wherein said erasing means is located on said transport path downstream of said fixing means.

26. An apparatus as claimed in claim 25, further comprising curved guide members for guiding said sheet being transported from said fixing means.

27. An apparatus as claimed in claim 2, wherein the coloring agent of the recording agent comprises either of a decolorizable and an undecolorizable coloring agent;

said image forming means of said recording means comprising:

first developing means for effecting development with the recording agent implemented by the decolorizable coloring agent; and second developing means for effecting development with the recording agent implemented by the undecolorizable coloring agent;

said apparatus being selectively operable in a decolorizable image form mode with said first developing means, in an undecolorizable image form mode with said second developing means, or in an image erase mode.

28. An apparatus as claimed in claim 1, wherein said erasing means decolorizes the visible image recorded in the sheet by applying a white toner to said sheet.

29. An apparatus as claimed in claim 1, wherein said erasing means decolorizes the visible image recorded on the sheet by rubbing said sheet with a roller having a rough surface.

* * * * *

UNITED STATES PATENT AND TRADEMARK OFFICE

CERTIFICATE OF CORRECTION

PATENT NO. : 5,400,123

DATED : March 21, 1995

INVENTOR(S) : Masumi SATO, et al.

It is certified that error appears in the above-indentified patent and that said Letters Patent is hereby corrected as shown below:

On the title page, Item [75], the eighth inventor's name should read:

--Masanao Ehara--

Signed and Sealed this

Sixth Day of June, 1995

Bruce Lehman

*Attest:*

BRUCE LEHMAN

*Attesting Officer*

*Commissioner of Patents and Trademarks*